US009833081B2

(12) United States Patent
DeFranks et al.

(10) Patent No.: US 9,833,081 B2
(45) Date of Patent: Dec. 5, 2017

(54) MATTRESS WITH FLEXIBLE PRESSURE SENSOR

(71) Applicant: DREAMWELL, LTD., Las Vegas, NV (US)

(72) Inventors: Michael S. DeFranks, Atlanta, GA (US); Michael A. Golin, Atlanta, GA (US)

(73) Assignee: DREAMWELL, LTD., Las Vegas, NV (US)

( * ) Notice: Subject to any disclaimer, the term of this patent is extended or adjusted under 35 U.S.C. 154(b) by 0 days.

(21) Appl. No.: 15/352,793

(22) Filed: Nov. 16, 2016

(65) Prior Publication Data

US 2017/0135494 A1 May 18, 2017

Related U.S. Application Data

(60) Provisional application No. 62/256,404, filed on Nov. 17, 2015.

(51) Int. Cl.

| | |
|---|---|
| ***A47C 27/00*** | (2006.01) |
| ***A47C 31/00*** | (2006.01) |
| ***A47C 31/12*** | (2006.01) |
| ***A47C 27/12*** | (2006.01) |
| ***A47C 27/05*** | (2006.01) |

(52) U.S. Cl.

CPC ..... *A47C 31/00* (2013.01); *A47C 27/002* (2013.01); *A47C 27/05* (2013.01); *A47C 27/121* (2013.01); *A47C 31/123* (2013.01)

(58) Field of Classification Search

CPC ..... A47C 27/00; A47C 27/002; A47C 27/05; A47C 27/053; A47C 27/056; A47C 31/00; A47C 31/123; A61B 5/00; A61B 5/0002; A61B 5/002; A61B 5/0022; A61B 5/0205; A61B 5/02055

USPC ..... 5/690, 694, 727, 728; 340/573.1, 575

See application file for complete search history.

(56) References Cited

U.S. PATENT DOCUMENTS

| | | | | |
|---|---|---|---|---|
| 6,308,354 | B1 | 10/2001 | Lilly et al. | |
| 7,849,751 | B2 * | 12/2010 | Clark | A61B 5/107 623/20.14 |
| 8,234,929 | B2 * | 8/2012 | Clark | A61B 5/107 73/768 |
| 8,525,680 | B2 * | 9/2013 | Riley | A61B 5/02055 340/573.1 |
| 8,820,173 | B2 | 9/2014 | Clark et al. | |
| 8,844,073 | B2 * | 9/2014 | Riley | A61B 5/02055 177/144 |

(Continued)

*Primary Examiner* — Robert G Santos

(74) *Attorney, Agent, or Firm* — Cantor Colburn LLP

(57) ABSTRACT

Mattresses including a polymeric contact sensor configured to provide real-time dynamic contact information, which can then be used to report sleep quality, body position and/or pressure distributions to the user. The polymeric contact sensors could also be used to control parameters of the mattress and/or foundation with adjustable firmness for a given position and/or body shape/type/size. The polymeric contact sensor includes a plurality of flexible strips formed of a polymeric material and a conductive filler, wherein the polymeric contact sensor is in electrical communication with a data acquisition terminal, wherein the polymeric contact sensor is disposed on or within the upholstery layer, or on or within the quilt layer, or on a top surface of the innercore unit.

11 Claims, 1 Drawing Sheet

(56) References Cited

U.S. PATENT DOCUMENTS

| | | | | |
|---|---|---|---|---|
| 9,044,204 | B2 * | 6/2015 | Riley | A61B 5/02055 |
| 9,095,275 | B2 * | 8/2015 | Clark | A61B 5/0031 |
| 9,549,705 | B2 * | 1/2017 | Riley | A61B 5/6892 |
| 9,552,460 | B2 * | 1/2017 | Riley | A61B 5/02055 |
| 2006/0184067 | A1 * | 8/2006 | Clark | A61B 5/107<br>600/587 |
| 2011/0068935 | A1 * | 3/2011 | Riley | A61B 5/02055<br>340/575 |
| 2011/0138932 | A1 * | 6/2011 | Clark | A61B 5/107<br>73/862.68 |
| 2011/0301440 | A1 * | 12/2011 | Riley | A61B 5/02055<br>600/301 |
| 2012/0068759 | A1 * | 3/2012 | Clark | G01L 1/205<br>327/517 |
| 2012/0123716 | A1 * | 5/2012 | Clark | A61B 5/0031<br>702/65 |
| 2013/0204157 | A1 * | 8/2013 | Clark | A61B 5/4576<br>600/547 |
| 2013/0342351 | A1 * | 12/2013 | Riley | A61B 5/02055<br>340/573.1 |
| 2015/0005675 | A1 * | 1/2015 | Riley | A61B 5/02055<br>600/595 |
| 2015/0128354 | A1 * | 5/2015 | Greenstein | A61G 5/128<br>5/710 |
| 2015/0216474 | A1 * | 8/2015 | Riley | A61B 5/0205<br>600/301 |
| 2017/0135494 | A1 * | 5/2017 | DeFranks | A47C 31/00 |

* cited by examiner

MATTRESS WITH FLEXIBLE PRESSURE SENSOR

CROSS REFERENCE TO RELATED APPLICATIONS

This application is a NON-PROVISIONAL of and claims the benefit of U.S. Provisional Patent Application Ser. No. 62/256,404, filed Nov. 17, 2015, which is fully incorporated herein by reference in its entirety.

BACKGROUND

The present disclosure generally relates to a mattress with a flexible conductive polymeric sensor.

Current pressure sensing mechanisms for mattresses are costly, cumbersome, and non-transparent to feel. Pressure sensing in a mattress can provide the consumer with helpful information about sleep quality, sleeping position and sleep habits. When combined with multipoint sensing and time based analysis, pressure sensors can be used to gather even more information; however, pressure sensors are often difficult to implement into a mattress because of their lack of elasticity and impact on changing the feel of the mattress.

BRIEF SUMMARY

Disclosed herein are mattresses with a flexible pressure sensor. In one embodiment, the mattress comprises a base layer; an innercore layer overlaying the base layer, the innercore comprising coil springs, foam, and combinations thereof; an upholstery layer overlaying the innercore layer; a quilt or fabric layer overlaying the upholstery layer; and a polymeric contact sensor comprising a plurality of flexible strips formed of a polymeric material and a conductive filler, wherein the polymeric contact sensor is in electrical communication with a data acquisition terminal, wherein the polymeric contact sensor is disposed on or within the base layer, upholstery layer, or on or within the quilt layer, or on a top surface of the innercore unit.

The disclosure may be understood more readily by reference to the following detailed description of the various features of the disclosure and the examples included therein.

BRIEF DESCRIPTION OF THE SEVERAL VIEWS OF THE DRAWINGS

Referring now to the figures wherein the like elements are numbered alike.

DETAILED DESCRIPTION

Figure 1:
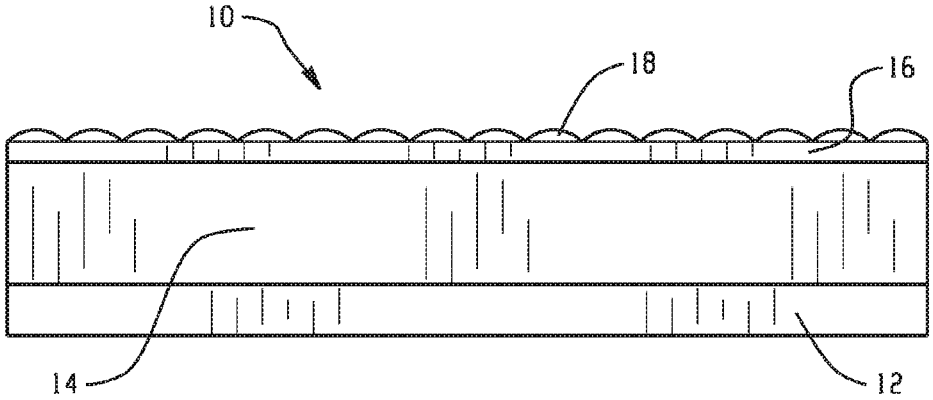
FIG. 1 is a side view of an exemplary mattress including a polymeric contact sensor the form of intersecting strips in accordance with the present disclosure.

Disclosed herein are mattresses including one or more polymeric contact sensors and methods of using the polymeric contact sensors. As will be described in greater detail below, the polymeric contact sensors are placed in the upholstery and/or in the quilt layer of the mattress and generally include a composite of a flexible polymer and electrically conductive filler. These polymeric contact sensors can be configured to provide real-time dynamic contact information, which can then be used to report sleep quality, body position and/or pressure distributions to the user. The polymeric contact sensors could also be used to control parameters of the mattress and/or foundation with adjustable firmness for a given position and/or body shape/type/size.

Sensors using the conductive polymer composite can maintain elasticity and can be constructed in any shape, e.g., strips, grids, sheets, and the like. These methods of construction lead to a more transparent feel. Moreover, the elasticity and the relative thin structure of the polymeric contact sensor as disclosed herein allows for a sensing mechanism that remains largely unnoticed by the user. It is anticipated that it would not change the feel of the mattress in a discernable way. These sensors are cost effective, allowing for implementation in a large range of products. The number, size and orientation of the sensors are not intended to be limited and will generally be dictated by the intended precision of measure and mattress dimension. Suitable sensors are described in US Pat. No. 8,820,173, incorporated herein by reference in its entirety.

In some embodiments, the polymer composite may contain less than 10% by weight of the conductive filler relative to the polymer, thereby maintaining the physical properties of the sensor to be nearly identical to that of the polymer itself. In this manner, the amount of flexure can be controlled and maintained such that the presence of the sensors can go largely undetected by an end user.

In general, any polymer can be used to for the polymeric contact sensor with the proviso that the resulting polymeric contact sensor is flexible. For example, various polyolefins, polyurethanes, polyester resins, epoxy resins, and the like can be utilized to form the contact sensors described herein. In certain aspects, the composite material can include engineering and/or high performance polymeric materials. In one particular aspect, the composite material can include UHMWPE. UHMWPE is generally classified as an engineering polymer, and possesses a unique combination of physical and mechanical properties that allows it to perform extremely well in rigorous wear conditions.

Conductive fillers as are generally known in the art and can be combined with the polymeric material of choice to form the polymeric contact sensors. The conductive fillers can be, for example and without limitation, carbon black and other known carbons, gold, silver, aluminum, copper, chromium, nickel, platinum, tungsten, titanium, iron, zinc, lead, molybdenum, selenium, indium, bismuth, tin, magnesium, manganese, cobalt, titanium germanium, mercury, and the like.

In general, the polymeric material and the conductive filler can be combined in any suitable fashion, which can generally be determined at least in part according to the characteristics of the polymeric material. For example, and depending upon the polymers involved, the materials can be combined by mixing at a temperature above the melting temperature of the polymer (conventional melt-mixing) and the filler materials can be added to the molten polymer, for example, in a conventional screw extruder, paddle blender, ribbon blender, or any other conventional melt-mixing device. The materials can also be combined by mixing the materials in an appropriate solvent for the polymer (conventional solution-mixing or solvent-mixing) such that the polymer is in the aqueous state and the fillers can be added to the solution. Optionally, an appropriate surfactant can be added to the mixture of materials to permit or encourage evaporation of the solvent, resulting in the solid conductive composite material. In another aspect, the materials can be mixed below the melting point of the polymer and in dry form. In this aspect, the materials can be mixed by a standard vortex mixer, a paddle blender, a ribbon blender, or the like, such that the dry materials are mixed together before further processing.

When mixing the components of the composite material, the mixing can be carried out at any suitable conditions. For example, in one aspect, the components of the composite material can be mixed at ambient conditions. In other aspects, however, the components of the composite material can be mixed at non-ambient conditions. For example, the components of the composite material can be mixed under non-ambient conditions to, for example and without limitation, maintain the materials to be mixed in the desired physical state and/or to improve the mixing process.

When dry mixing the materials to be utilized in the composite to form the sensor, the exact particulate dimensions of the materials are not generally critical to the present disclosure. Following formation of the mixture comprising the conductive filler and the polymeric material, the mixture can be converted as desired to form a solid composite material. For example and without limitation, the composite polymeric material can be converted via a conventional extrusion or injection molding process.

The composite material of the disclosed sensors can optionally comprise other materials in addition to the primary polymeric component and the conductive filler discussed above. In one aspect, the composite material can comprise additional fillers, including, for example and without limitation, various ceramic fillers, aluminum oxide, zirconia, calcium, silicon, fibrous fillers, including carbon fibers and/or glass fibers, or any other fillers as are generally known in the art. In another aspect, the composite material can include an organic filler, including for example and without limitation, tetrafluoroethylene or a fluororesin. In this embodiment, it is contemplated that the organic filler can be added to improve sliding properties of the composite material, for example.

Accordingly, following any desired molding, shaping, cutting and/or machining and also following any desired physical combination of the formed composite material with other non-conductive materials (various aspects of which are discussed further below), the composite materials of the contact sensors described herein, which comprise at least one conductive filler, can be formed into the desired sensor shape and placed in electrical communication with a data acquisition terminal. For example, in one aspect, the composite material of the sensor can be connected to a data acquisition terminal. In this embodiment, the composite material can be connected to the data acquisition terminal by, for example and without limitation, soldering, conventional alligator clips, conductive epoxy, conductive silver ink, conventional rivet mechanisms, conventional crimping mechanisms, and other conventional mechanisms for maintaining electrical connections. In another aspect, the composite material can be machined to accept a connector of a predetermined geometry within the composite material itself. Other connection regimes as are generally known in the art may optionally be utilized, however, including fixed or unfixed connections to any suitable communication system between the composite material and the data acquisition terminal. In particular, no particular electrical communication system is required of the contact sensors described herein. For example, in other aspects, the electrical communication between the composite material and the data acquisition terminal can be wireless, rather than a hard wired connection.

In one aspect, the data acquisition terminal can comprise data acquisition circuitry. In another aspect, the data acquisition terminal can comprise at least one multiplexer placed in electrical communication with a microcontroller via the data acquisition circuitry. In an additional aspect, the data acquisition circuitry can comprise at least one op-amp for providing a predetermined offset and gain through the circuitry. In this aspect, the at least one op-amp can comprise a converting op-amp configured to convert a current reading into a voltage output. It is contemplated that the converting op-amp can measure current after it has passed through the at least one multiplexer and then convert the measured current into a voltage output. In a further aspect, the data acquisition terminal can comprise an Analog/Digital (A/D) converter. In this aspect, the A/D converter can be configured to receive the voltage output from the converting op-amp. It is contemplated that the A/D converter can convert the voltage output into a digital output signal. In yet another aspect, the data acquisition terminal can be in electrical communication with a computer having a processor. In this aspect, the computer can be configured to receive the digital output signal from the A/D converter. It is contemplated that the A/D converter can have a conventional Wi-Fi or Bluetooth transmitter for wirelessly transmitting the digital output signal to the computer. It is further contemplated that the computer can have a conventional Wi-Fi or Bluetooth receiver to receive the digital output signal from the A/D converter. As electrical communications methods and electrical data analysis methods and systems are generally known in the art, these particular aspects of the disclosed contact sensor systems are not described in great detail herein.

The present methods and systems can be operational with numerous other general purpose or special purpose computing system environments or configurations. Examples of well-known computing systems, environments, and/or configurations that can be suitable for use with the system and method comprise, but are not limited to, Smartphones, personal computers, server computers, laptop devices, handheld electronic devices, vehicle-embedded electronic devices, and multiprocessor systems. Additional examples comprise set top boxes, programmable consumer electronics, network PCs, minicomputers, mainframe computers, distributed computing environments that comprise any of the above systems or devices, and the like.

During use, the sensors of the present disclosure can be located in association with a mattress component so as to form a contact junction between a surface of the mattress component and the contact surface of the sensor. The sensor can then be placed in electrical communication with a data acquisition terminal, for example via a fixed or unfixed hard-wired or a wireless communication circuit, and data can be gathered concerning contact between the sensor and the member. In one particular aspect, dynamic contact data can be gathered. For example, any or all of contact stress data, internal stress data, load, impact data, and the like can be gathered.

Figure 2:
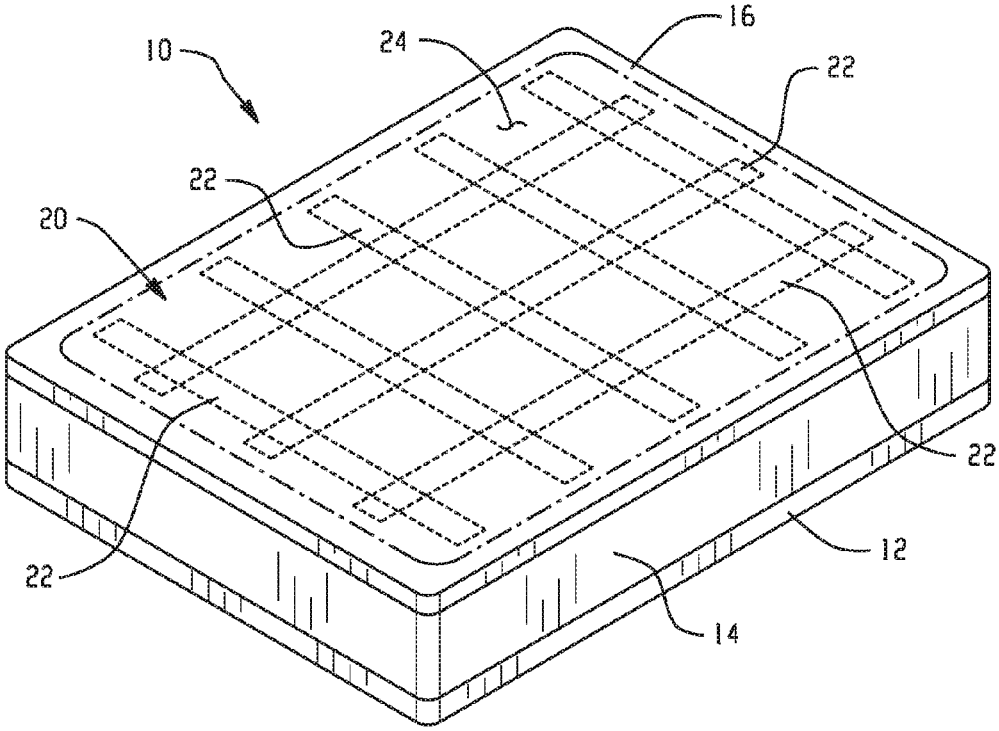
FIG. 2 is a perspective view of the mattress of FIG. 1.

Turning now to FIGS. 1-2, there is shown an exemplary mattress 10 including a polymeric contact sensor the form of intersecting strips in accordance with the present disclosure. The mattress 10 generally includes a base layer 12, an inner core 14, an upholstery layer 16, and a quilt layer 18. The quilt panel portion 18 is made up of foam and/or fiber layers with an outer covering of ticking. The components of the quilt panel portion 18 are stitched together with thread to form a quilt pattern. In other embodiments, the panel portion may be guiltless and utilize a zipper style cover system of fabric. The upholstery portion 16 is generally positioned between the inner core 12 and the quilt panel portion 18.

Each upholstery portion is constructed of one or more layers. Such layers may include, but is not intended to be limited to wrapped coils and/or fiber layers and/or foam layers. Optionally, the upholstery portion 16 can be positioned between the innerspring or the foam core as may be desired in other embodiments.

As shown more clearly in FIG. 2, the conductive polymeric contact sensor 20 is shown disposed on the upholstery portion, wherein the quilt layer 18 (removed for clarity) would overlay the conductive polymeric contact sensor 20 during use. Alternatively, the conductive polymeric contact sensor 20 may be disposed within the quilt layer 18, within the upholstery layer 16, underneath the upholstery layer 16, on top of base layer 12, underneath base layer 12 and/or on a top surface of the inner core unit 14.

The conductive polymeric contact sensor 20 is shown including multiple opposing sensing strips 22 across the surface 24 of the sensor 20, which can be utilized to determine pressure, movement, and coordinate position of a user on the mattress. By way of example, the strips can be laid in different opposing orientations as shown on separate but identically shaped sensors in a multi-sensor testing apparatus. In any case, by varying the orientation of sensor strips on multiple, but essentially identical surfaces, virtual cross-points can be created when the data from the different surfaces is correlated. In particular, when contacts of the same shape and magnitude at the same location of different surfaces are recognized, a virtual data point at the cross-point can be created. As can be seen, this aspect can allow the formation of fewer electrical connections and wires in order to provide data to the acquisition and analysis location, which may be preferred in some aspects due to increased system simplicity.

In other embodiments, the strips can be generally parallel to one another extending from the head portion to the foot portion of the mattress or from one mattress sidewall to the opposing mattress sidewall.

Electrical resistance measurements from the contact strips can be processed by a data acquisition terminal. A DC voltage would be applied to the strips by which the return voltage would determine the electrical resistance of each strip. Contact pressure modulates the electrical resistance within the composite strip. The changes in DC voltage between a compressed and uncompressed sensor determines the load. Combining multiple sensors together in an array allows for determination of load distribution. Real-time monitoring of the load distribution is used to evaluate motion, changes in pressure points and body function.

The sensor array as described herein can also be implemented in real-time with various control devices. In one embodiment the sensor could communicate with an adjustable mattress and/or foundation to change position based on pressure or body function. In another embodiment the mattress and/or foundation could change firmness through various mechanisms based on measured pressure distribution.

As used herein, the singular forms "a," "an" and "the" include plural referents unless the context clearly dictates otherwise. Thus, for example, reference to a "sensor" includes aspects having two or more sensors unless the context clearly indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes examples where said event or circumstance occurs and examples where it does not.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A mattress comprising:

a base layer;

an innercore layer overlaying the base layer, the innercore comprising coil springs, foam, and combinations thereof;

an upholstery layer overlaying the innercore layer;

a quilt or fabric layer overlaying the upholstery layer; and a polymeric contact sensor comprising a plurality of intersecting flexible strips formed of a polymeric material and a conductive filler, wherein the polymeric contact sensor is in electrical communication with a data acquisition terminal, wherein the polymeric contact sensor is disposed on or within the upholstery layer, or on a top surface of the innercore layer, and wherein the polymeric sensor is configured to determine pressure, movement, and coordinate position of a user on the mattress.

2. The mattress of claim 1, wherein the conductive filler is less than 10% by weight relative to the polymeric material.

3. The mattress of claim 1, wherein the polymeric material comprises polyolefins, polyurethanes, polyester resins, or epoxy resins.

4. The mattress of claim 1, wherein the conductive filler comprises carbon black, gold, silver, aluminum, copper, chromium, nickel, platinum, tungsten, titanium, iron, zinc, lead, molybdenum, selenium, indium, bismuth, tin, magnesium, cobalt, titanium germanium, or mercury.

5. The mattress of claim 1, wherein the plurality of flexible strips further comprises a filler.

6. The mattress of claim 5, wherein the filler comprises a ceramic.

7. The mattress of claim 5, wherein the filler comprises aluminum oxide, zirconia, calcium, silicon, fibrous fillers, carbon fiber or glass fibers.

8. The mattress of claim 1, wherein the data acquisition terminal comprises data acquisition circuitry comprising at least one multiplexer in electrical communication with a microcontroller via the data acquisition circuitry.

9. The mattress of claim 1, wherein the plurality of flexible strips are perpendicularly oriented in different opposing directions to form virtual cross points at intersections thereof.

10. The mattress of claim 1, wherein the plurality of flexible strips are oriented parallel to one another.

11. A mattress comprising:

a base layer;

an innercore layer overlaying the base layer, the innercore comprising coil springs;

an upholstery layer overlaying the innercore layer;

a quilt or fabric layer overlaying the upholstery layer; and a polymeric contact sensor comprising a plurality of intersecting flexible strips formed of a polymeric material and a conductive filler, wherein the polymeric contact sensor is in electrical communication with a data acquisition terminal, wherein the polymeric contact sensor is disposed on or within the upholstery layer, or on or within the quilt layer, or on a top surface of the innercore layer, and wherein the polymeric sensor is configured to determine pressure, movement, and coordinate position of a user on the mattress.

* * * * *